US006199338B1

(12) United States Patent
Hudson, Jr. et al.

(10) Patent No.: US 6,199,338 B1
(45) Date of Patent: Mar. 13, 2001

(54) UNIVERSAL STARTER SHINGLE

(75) Inventors: Willard Calvin Hudson, Jr., Arlington, TX (US); Randy Alan Hughes; Casimir Paul Weaver, both of Northport, AL (US)

(73) Assignee: Elk Corporation of Dallas, Dallas, TX (US)

( * ) Notice: Subject to any disclaimer, the term of this patent is extended or adjusted under 35 U.S.C. 154(b) by 0 days.

(21) Appl. No.: 09/371,293

(22) Filed: Aug. 10, 1999

(51) Int. Cl.[7] ..... E04D 1/12
(52) U.S. Cl. ..... 52/518; 52/98; 52/105
(58) Field of Search ..... 52/518, 522, 523, 52/533, 100, 105, 98

(56) References Cited

U.S. PATENT DOCUMENTS

| | | | |
|---|---|---|---|
| 0,908,125 | 12/1908 | Overbury . | |
| 1,583,163 | 5/1926 | Munro . | |
| 2,194,427 | 3/1940 | Kirschbraun | 91/68 |
| 2,300,488 | 11/1942 | Cuno | 108/7 |
| 2,667,131 | 1/1954 | Clarvoe et al. | 108/7 |
| 3,003,288 | 10/1961 | Leibrook et al. | 50/103 |
| 3,082,577 | 3/1963 | Fasold et al. | 50/243 |
| 3,247,631 | 4/1966 | Lovness | 52/173 |
| 3,763,609 * | 10/1973 | Probst | 52/105 X |
| 4,404,783 | 9/1983 | Freiborg | 52/518 |
| 4,559,267 | 12/1985 | Freshwater et al. | 428/352 |
| 4,580,389 | 4/1986 | Frieborg | 52/747 |
| 4,637,191 | 1/1987 | Smith | 52/98 |
| 4,757,652 | 7/1988 | Kalkanoglu | 52/173 |
| 4,992,315 | 2/1991 | Zickell et al. | 428/41 |
| 5,037,685 | 8/1991 | Richards et al. | 428/40 |
| 5,865,003 | 2/1999 | Klett et al. | 52/518 |

OTHER PUBLICATIONS

Tamko Roofing Products Inc., Shingle Starter Advertisement (1997).

* cited by examiner

*Primary Examiner*—Robert W. Gibson, Jr.
(74) *Attorney, Agent, or Firm*—Baker Botts LLP

(57) ABSTRACT

A strip shingle is manufactured with a perforation along a lengthwise centerline. The traditional headlap and buttlap areas are substantially identical to one another, each having a line of adhesive material near the shingle edge whereby breaking the shingle along the perforated center line yields two starter shingles which can be used with any type of roofing shingle.

13 Claims, 4 Drawing Sheets

UNIVERSAL STARTER SHINGLE

TECHNICAL FIELD OF INVENTION

The present invention relates to roofing shingles, and, more particularly, to shingles for use along the rakes and eaves of a roof, known in the art as starter shingles.

BACKGROUND OF THE INVENTION

A typical asphalt roofing shingle has a buttlap portion, which is the exposed surface visible on a roof, and a headlap portion, which is secured to the roof by glue or nails or other appropriate securing means. Shingles of this type are generally installed on a roof by working up the roof from the edge to the peak, the headlap portion of each shingle being covered by the buttlap portions of the next course of installed shingles.

The most popular asphalt shingles fall into three different categories: strip, three-tab and laminated. FIG. 1A depicts the simplest of the three types, a strip shingle. The strip shingle 3 has a headlap portion 8 and a buttlap portion 5. The phantom lines of the figure indicate the position of the course of shingles installed over the shingle 3.

FIG. 1B depicts a typical three-tab shingle 12 with headlap portion 18 and buttlap portion 15. The three-tab shingle is so called because the buttlap portion is divided into three tabs 21, 24 and 27 such that, when the overlying course of shingles is installed, the exposed buttlap portion appears as three smaller individual shingles. The phantom lines of FIG. 1B indicate the position of the course of shingles installed over the shingle 12.

FIG. 1C depicts a laminated shingle with headlap portion 33 and buttlap portion 36. A laminated shingle differs from the strip and three-tab shingles in that the laminated shingle is a two-ply construction wherein the tabs 39, 42 and 45 of an overlay ply are spaced relatively far apart and a backer strip 48, which is visible between the tabs, is adhered underneath. This gives a desirable thicker appearance to the shingle. The phantom lines of FIG. 1C indicate the position of the course of shingles installed over the shingle 30.

Each of the standard shingles depicted in FIGS. 1A, 1B and 1C also has a line of self-sealing adhesive patches 50 on the headlap portion. The adhesive provides a convenient means for sealing the leading edge of the next course of installed shingles, thereby assisting in preventing wind from getting under the buttlap portion and blowing the shingles off of the roof. The adhesive may be deposited on the shingle in any number of alternative ways, such as in a solid line or as dots across the headlap portion. This stick-down system has been known in the art for some time and is described in U.S. Pat. No. 4,559,267, the disclosure of which is incorporated herein by reference. In an alternative stick-down system, the self-sealing adhesive is placed near the leading edge of the underside of the buttlap portion of the shingle so that when the shingle is installed, the leading edge adheres to the headlap portion of the previous course of shingles.

Because there is no previous course of shingles, either with or without an adhesive material deposited thereon, present at the edge of the roof when a roofer starts to install shingles, roofers have typically engaged in the labor intensive and wasteful practice of trimming the buttlap portion from standard shingles and nailing down a headlap course at the edge of the roof. The shingles in this headlap course are sometimes referred to as starter shingles. The use of starter shingles is always necessary, even when shingles of the type having the adhesive on the underside of the buttlap portion are used, to ensure proper weatherproofing. After installing a course of starter shingles, the roofers can then lay down the first row of shingles, securing the buttlap portion to the trimmed shingles, and begin working up the roof. This type of starter shingle is the subject of U.S. Pat. No. 4,637,191, wherein a three-tab shingle, as described above with reference to FIG. 1B, is manufactured with perforations between the headlap and buttlap portions for ease of separation. The patent further discusses using the removed buttlap tab portions as shingling material elsewhere on the roof, e.g., near the peak as a "topping out" course of shingles in instances where standard ridge shingles do not bridge the gap between shingle courses on either side of the peak. The need for a "topping out" course of shingles, however, does not always arise. In addition, while the buttlap portion of a strip or three-tab shingle may find a use elsewhere on the roof, the two-ply construction of a laminated shingle buttlap portion does not lend itself to recycled use and would be wasted in all instances.

It is therefore an object of the present invention to eliminate the often wasteful practice of cutting away the buttlap portion of a shingle associated with providing a roofing starter strip. It is a further object of the present invention to provide a starter strip that may be used universally with any type roofing shingle, e.g., strip, three-tab and laminated.

For a better understanding of the present invention, together with other and further objects, reference is made to the following description, taken in conjunction with the accompanying drawings and its scope will be pointed out in the appended claims.

SUMMARY OF THE INVENTION

In accordance with the invention, a strip shingle is manufactured with a perforation along a lengthwise centerline. The traditional headlap and buttlap areas are substantially identical to one another, each having a line of adhesive material near the shingle edge whereby breaking the shingle along the perforated center line yields two starter shingles which can be used with any type of roofing shingle. A release material may be applied to the underside of the inventive shingles to prevent the adhesive material from sticking to other shingles when packaged in the conventional stacked manner.

DETAILED DESCRIPTION OF THE INVENTION

Figure 2A:
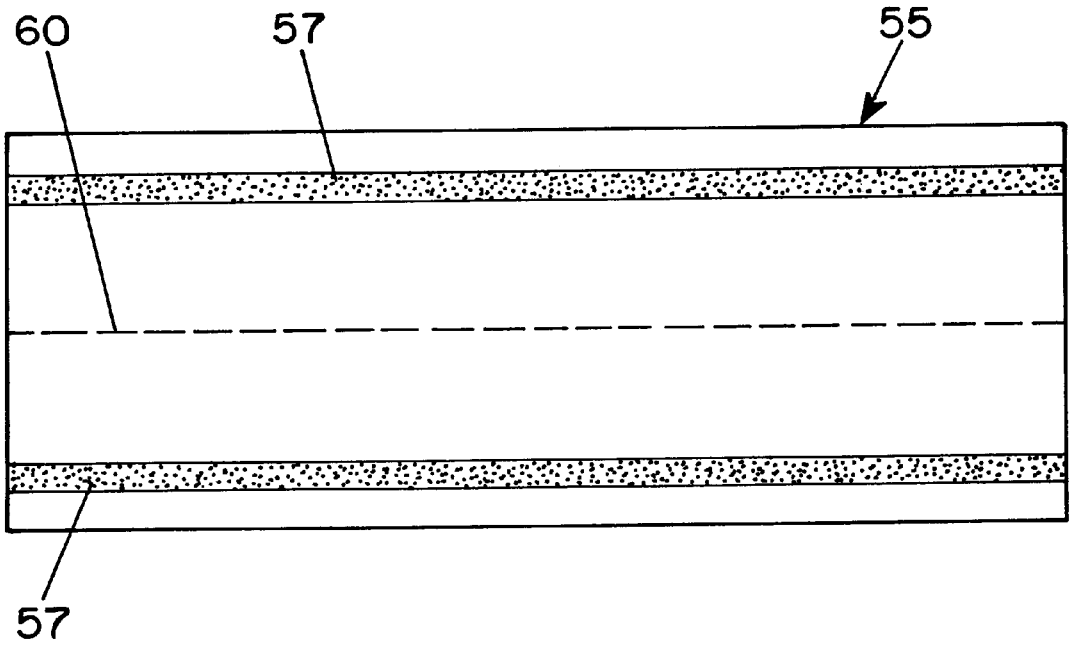
FIG. 2A is a top plan view of a first embodiment of the present invention.

With reference to FIG. 2A, a strip shingle 55 has two lines of self-sealing adhesive material 57 applied on the upper surface of the shingle. Each line of the adhesive material 57 is located in close proximity to a respective lengthwise edge of the shingle. The adhesive may be deposited on the shingle in any one of a number of alternative formations such as in a line of intermittent patches or dots. On a shingle of a standard width of 13 inches, a typical placement of the adhesive may be approximately one-half inch from each edge. The strip shingle 55 is perforated, or serrated, along a centerline 60 such that the shingle can be separated into two pieces with relative ease by folding the shingle along the serrated center line. Each piece can then be employed as a starter shingle at the edge of the roof.

Figure 1A:
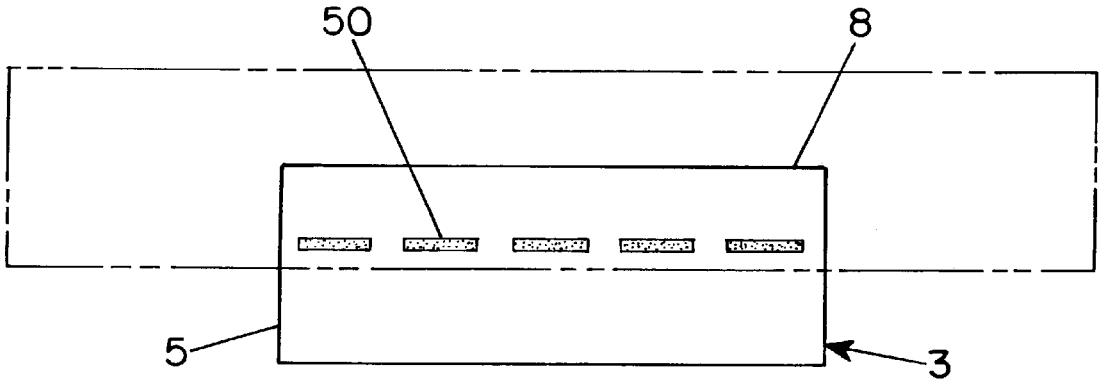
FIG. 1A PRIOR ART
FIG. 1A illustrates a prior art strip shingle.
Figure 1B:
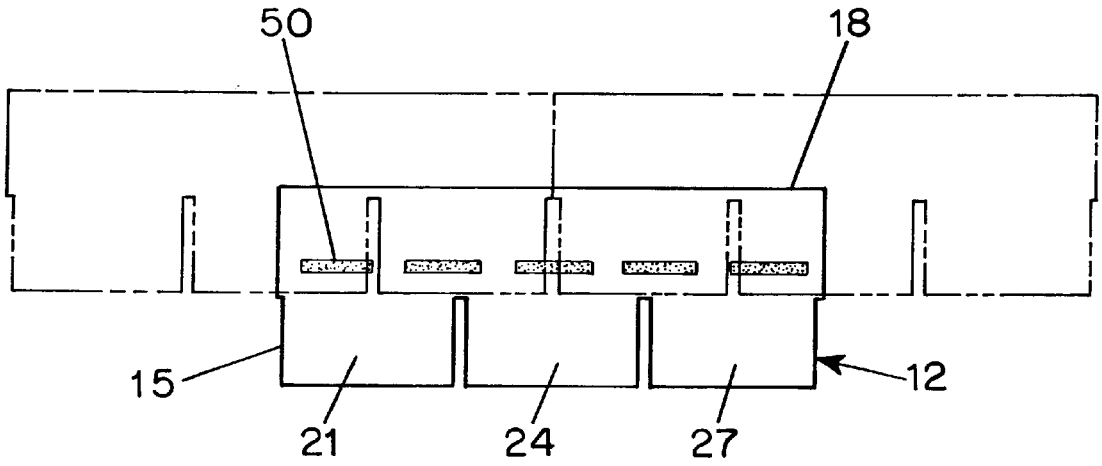
FIG. 1B PRIOR ART
FIG. 1B illustrates a prior art three-tab shingle.
Figure 1C:
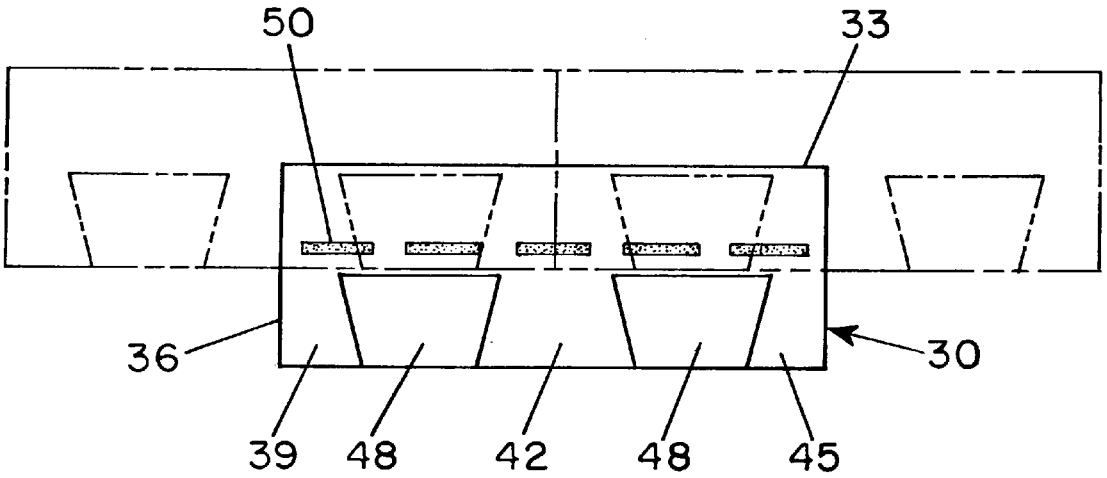
FIG. 1C PRIOR ART
FIG. 1C illustrates a prior art laminated shingle.
Figure 2B:
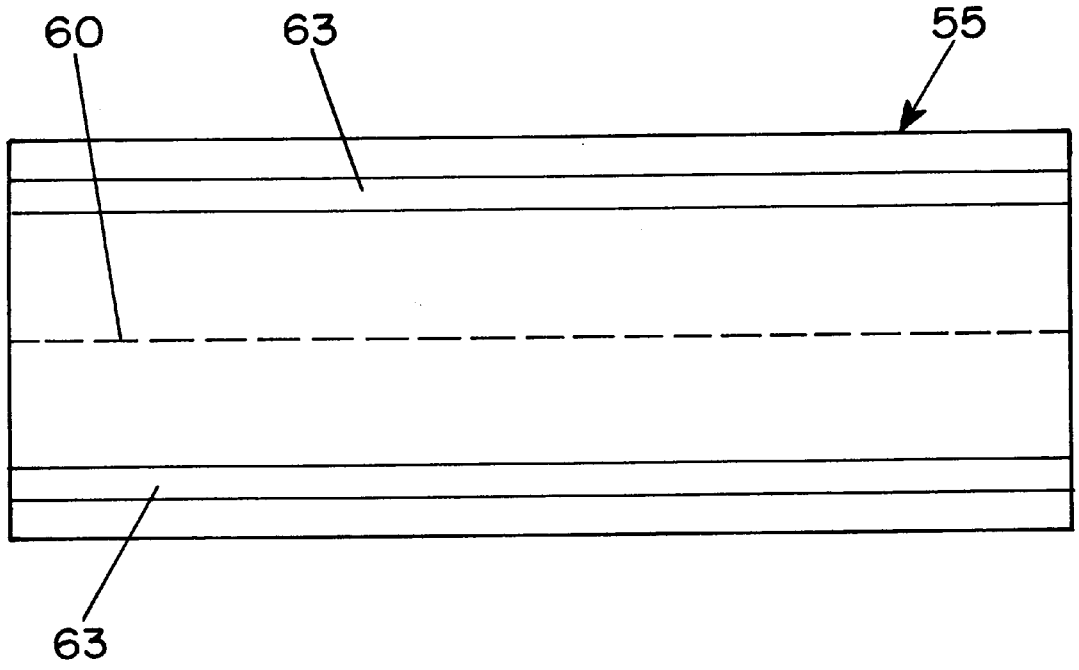
FIG. 2B is a bottom plan view of a first embodiment of the present invention shown in FIG. 2A.

FIG. 2B illustrates the underside of the shingle depicted in FIG. 2A. In FIG. 2B, two strips of a release material 63 are shown in locations corresponding to the locations of the adhesive material on the upper surface as shown in FIG. 2A. The release material 63 is typically made of a sheet material coated or impregnated with synthetic resins having high release properties. The release material serves the function of preventing the shingles from sticking to one another when the shingles are stacked one on top of the other for packaging and shipping, as is typical in the industry. The release material system has been known in the art and may be used with shingles of any type, including those shown in FIGS. 1A, 1B and 1C, in the manner described in U.S. Pat. No. 4,559,267.

The shingle of the present invention is used by first breaking the strip shingle 55 along the serrated centerline 60 which yields two usable starter shingles without any wasted material. A course of starter shingles is installed along the eaves, rakes, valleys or any other area of a roof where a starter shingle is needed. The starter shingles are installed using conventional installation techniques, e.g., nailing or stapling. A first course of conventional shingles, e.g., strip, three-tab or laminated, is then installed over the course of starter shingles, with the adhesive strip of the starter shingles acting to secure the buttlap portion of the conventional shingles. Preferably, the starter shingles are installed with the adhesive positioned near the edge of the roof This reduces the area for wind to get under the buttlap of the first course of conventional shingles and thus minimizes the risk of the shingles being blown off the roof. After installing the first course of conventional shingles over the starter shingles, the roofer proceeds with the installation of subsequent courses up the roof toward the peak in the conventional manner.

Figure 3A:
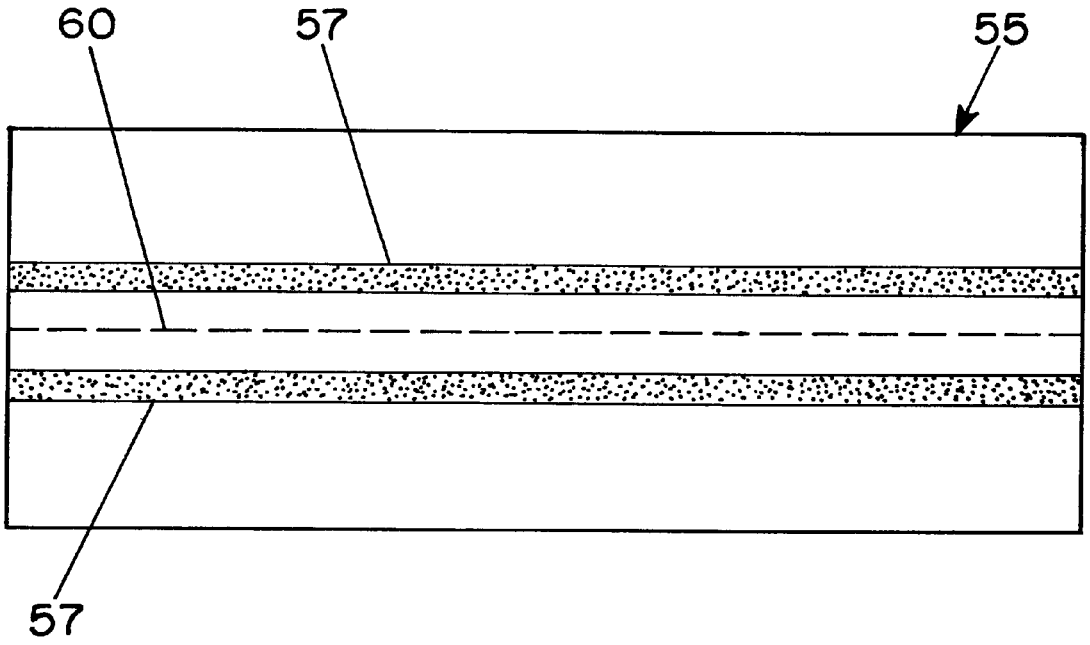
FIG. 3A is a top plan view of a second embodiment of the present invention.
Figure 3B:
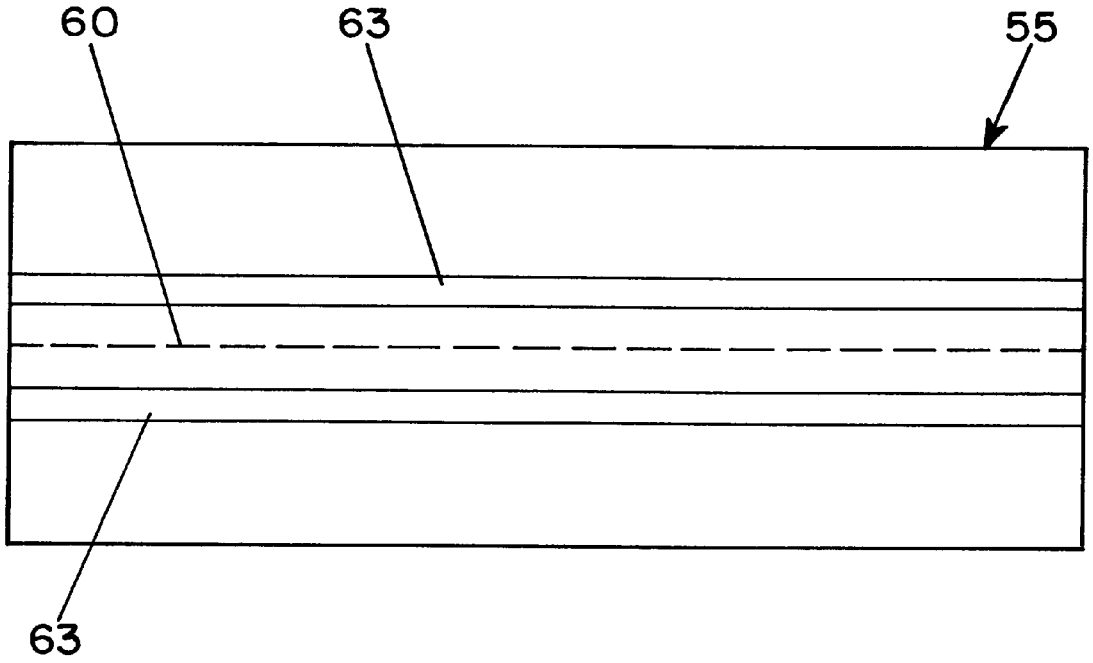
FIG. 3B is a bottom plan view of a second embodiment of the present invention shown in FIG. 3A.

FIG. 3A illustrates a second embodiment of the present invention wherein the lines of self-sealing adhesive material 57 are located closer to the serrated centerline 60 than the lengthwise edges of the shingle. FIG. 3B depicts the underside of the second embodiment wherein the release strips 63 are similarly located closer to the serrated centerline 60 than the lengthwise edges of the shingle. Regardless of which of the two described embodiments is used, after the shingle 55 is separated into two pieces as described above, the resultant starter shingles will be substantially identical.

Figure 4A:
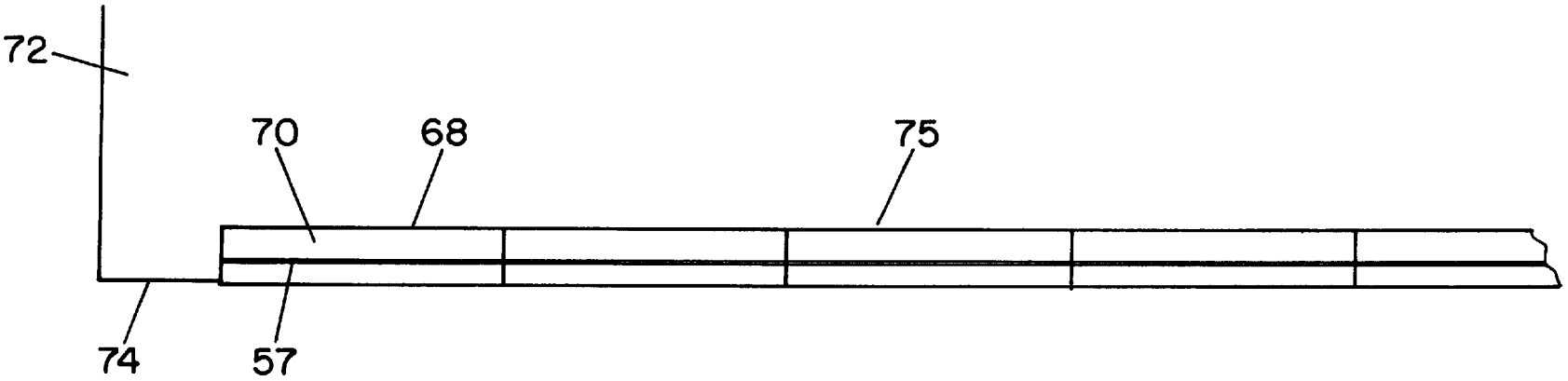
FIG. 4A illustrates the positioning of the starter shingles of the present invention along the edge of a roof.

FIG. 4A illustrates the preferred positioning of the starter shingles of the present invention along the edge of a roof. A course of starter shingles 75 is installed on a roof 72 along the entire front edge 74. In FIG. 4A, a small area of the edge of the roof is left uncovered solely for the purpose of showing that the preferred positioning of the starter shingle is at the edge 74 of the roof. The course of starter shingles 75 is preferably positioned such that each starter shingle's leading edge, i.e., the one at the roof's edge, is the edge to which the line of self-sealing adhesive 57 is closer. For example, in FIG. 4A, far edge 68 of starter shingle 70 is the edge formed from the serrated centerline 60 of the strip shingle shown in FIG. 2A after the strip shingle is separated along the centerline to form two starter shingles.

Figure 4B:
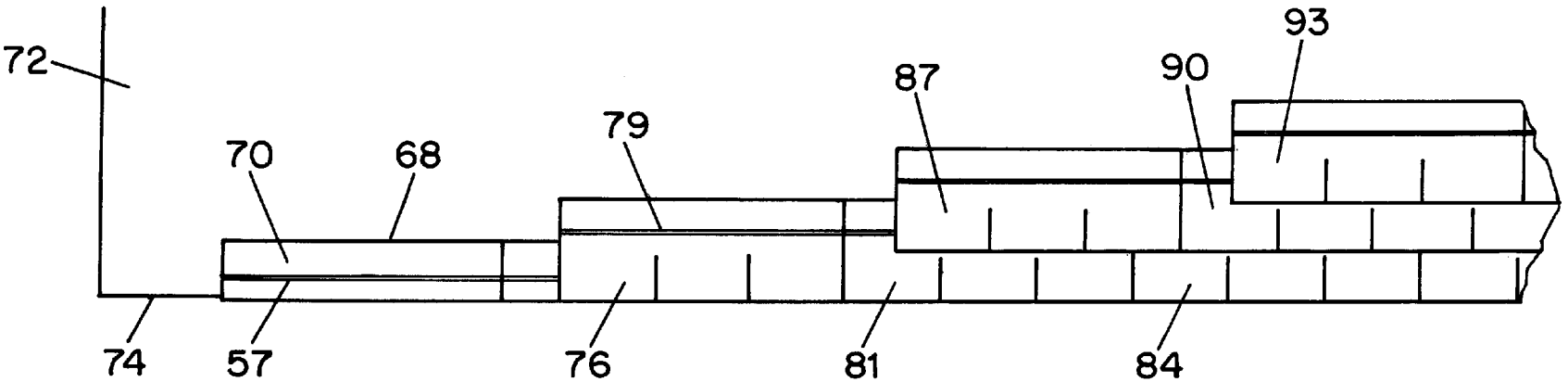
FIG. 4B illustrates the positioning of the starter shingles of the present invention on a roof in relation to the roof's edge and to conventional roofing shingles with which the starter shingles are used.

FIG. 4B illustrates the preferred positioning of the starter shingle of the present invention on a roof in relation to the roof's edge and to the conventional roofing shingles to be installed on the roof. As in FIG. 4A, starter shingle 70 is the first in the course of starter shingles. The conventional shingles 76, 81, 84, 87, 90 and 93 depicted in FIG. 4B are of the three-tab variety as shown in FIG. 1B. Each of the conventional three-tab shingles in FIG. 4B has a line of adhesive 79 which seals the shingle's headlap portion to the buttlap portions of the course of shingles installed above it. The first course of three-tab shingles 76, 81 and 84 is positioned so that the edge of the buttlap portion of each extends to the edge 74 of roof 72, and completely covers the length of the first course of starter shingles with which it is coextensive. Subsequent courses of shingles are installed in a conventional manner with the adhesive of the headlap portion of each course acting to seal down the buttlap portion of the overlying course. This is shown in FIG. 4B by the positioning of shingles 87 and 90 over shingles 81 and 84 and the positioning of shingle 93 over shingle 90.

While this invention has been described with reference to several illustrative examples and embodiments, they should not be interpreted as limiting the scope or spirit of the invention. In actual practice many modifications may be made by those of ordinary skill in the art without deviating from the scope of the invention as expressed in the appended claims.

I claim:

1. A roofing shingle having an upper surface, an underside, a length dimension and lengthwise edges, said shingle comprising two substantially identical portions defined by a serrated centerline running along the length of the shingle parallel to the lengthwise edges such that a roofer may separate the portions by folding the shingle along the serrated centerline, thereby yielding two starter shingles, each of said portions of said roofing shingle having a deposit of adhesive material on its upper surface.

2. A roofing shingle having an upper surface, an underside, a length dimension and lengthwise edges, said shingle comprising two substantially identical portions defined by a perforated centerline running along the length of the shingle parallel to the lengthwise edges such that a roofer may separate the portions by folding the shingle along the perforated centerline, thereby yielding two starter shingles, each of said portions of said roofing shingle having a deposit of adhesive material on its upper surface.

3. The roofing shingle of claim 1 or 2 wherein each deposit of adhesive material is linear and runs substantially parallel to the centerline and lengthwise edges.

4. The roofing shingle of claim 3 wherein each linear deposit of adhesive material is a solid line.

5. A. The roofing shingle of claim 3 wherein each linear deposit of adhesive material is an intermittent line.

6. The roofing shingle of claim 1 or 2 further comprising a release material on the underside of each of the two substantially identical portions.

7. The roofing shingle of claim 3 further comprising a release material on the underside of each of the two substantially identical portions, each release material being in the form of a linear strip running parallel to the centerline and lengthwise edges.

8. The roofing shingle of claim 3 wherein each linear deposit of adhesive material is close to a lengthwise edge than to the centerline.

9. The roofing shingle of claim 4 or 2 wherein each linear deposit of adhesive material is closer to a lengthwise edge than to the centerline.

10. The roofing shingle of claim 5 or 2 wherein each linear deposit of adhesive material is closer to a lengthwise edge than to the centerline.

11. The roofing shingle of claim 3 wherein each linear deposit of adhesive material is closer to the centerline than to a lengthwise edge.

12. The roofing shingle of claim 4 or 2 wherein each linear deposit of adhesive material is closer to the centerline than to a lengthwise edge.

13. The roofing shingle of claim 5 or 2 wherein each linear deposit of adhesive material is closer to the centerline than a lengthwise edge.

* * * * *